US009126230B1

(12) United States Patent
Maresca, Jr. et al.

(10) Patent No.: US 9,126,230 B1
(45) Date of Patent: Sep. 8, 2015

(54) FOGGING FORMULATIONS FOR FIXATION OF PARTICULATE CONTAMINATION IN DUCTWORK AND ENCLOSURES

(75) Inventors: Joseph W. Maresca, Jr., Sunnyvale, CA (US); Lori M. Kostelnik, Aiken, SC (US); James R. Kriskivich, Richland, WA (US); Rick L. Demmer, Idaho Falls, ID (US); Julia L. Tripp, Pocatello, ID (US)

(73) Assignee: Vista Engineering Technologies, Inc., Richland, WA (US)

( * ) Notice: Subject to any disclaimer, the term of this patent is extended or adjusted under 35 U.S.C. 154(b) by 448 days.

(21) Appl. No.: 13/317,831

(22) Filed: Oct. 27, 2011

Related U.S. Application Data

(60) Provisional application No. 61/456,001, filed on Oct. 28, 2010.

(51) Int. Cl.
*B05D 7/22* (2006.01)
*G21F 9/30* (2006.01)

(52) U.S. Cl.
CPC . *B05D 7/22* (2013.01); *G21F 9/307* (2013.01)

(58) Field of Classification Search
None
See application file for complete search history.

(56) References Cited

U.S. PATENT DOCUMENTS 4,529,449 A * 7/1985 Baustert et al. ..... 134/4
4,800,063 A * 1/1989 Mierswa et al. ..... 376/316
5,523,513 A * 6/1996 Milner ..... 588/1
5,878,355 A * 3/1999 Berg et al. ..... 588/2
6,153,809 A * 11/2000 Singh et al. ..... 588/255
6,504,077 B1 * 1/2003 Purohit et al. ..... 588/18
7,166,758 B2 * 1/2007 Nunez et al. ..... 588/18
7,951,227 B2 * 5/2011 Weatherman et al. ..... 95/149
2002/0192803 A1 * 12/2002 Rogers et al. ..... 435/252.1
2004/0115423 A1 * 6/2004 Rouppert et al. ..... 428/323
2006/0217584 A1 * 9/2006 Nunez et al. ..... 588/1

OTHER PUBLICATIONS

Conley et al., "Use of Fixatives to Accelerate Building Decontamination and Decommissioning (D&D)—9047," WM2009 Conference, Mar. 1-5, 2009, Phoenix, AZ, 7 pages.*

Harper et al., "Decontamination and Decommissioning of the 2000 Complex Facilities at Oak Ridge National Laboratory—11199," WM2011 Conference, Feb. 27-Mar. 3, 2011, Phoenix, AZ, 9 pages.*

* cited by examiner

*Primary Examiner* — William Phillip Fletcher, III
(74) *Attorney, Agent, or Firm* — K&L Gates LLP

(57) ABSTRACT

A method and an apparatus using aqueous fixatives for fogging of ventilation ductwork, enclosures, or buildings containing dust, lint, and particulates that may be contaminated by radionuclides and other dangerous or unsafe particulate contaminants, which method and apparatus are capable of (1) obtaining full coverage within the ductwork and (2) penetrating and fixing the lint, dust and large particles present in the ductwork so that no airborne particles are released during or after the application of the fixative. New aqueous fogging solutions outperform conventional glycerin-based solutions. These aqueous solutions will fog using conventional methods of application and contain a surfactant to aid wetting and penetration of the lint and dust, a binder to stabilize loose or respirable particles, and an agent to aid in fogging and enhance adhesiveness. The solutions are safe and easy to use.

37 Claims, 13 Drawing Sheets

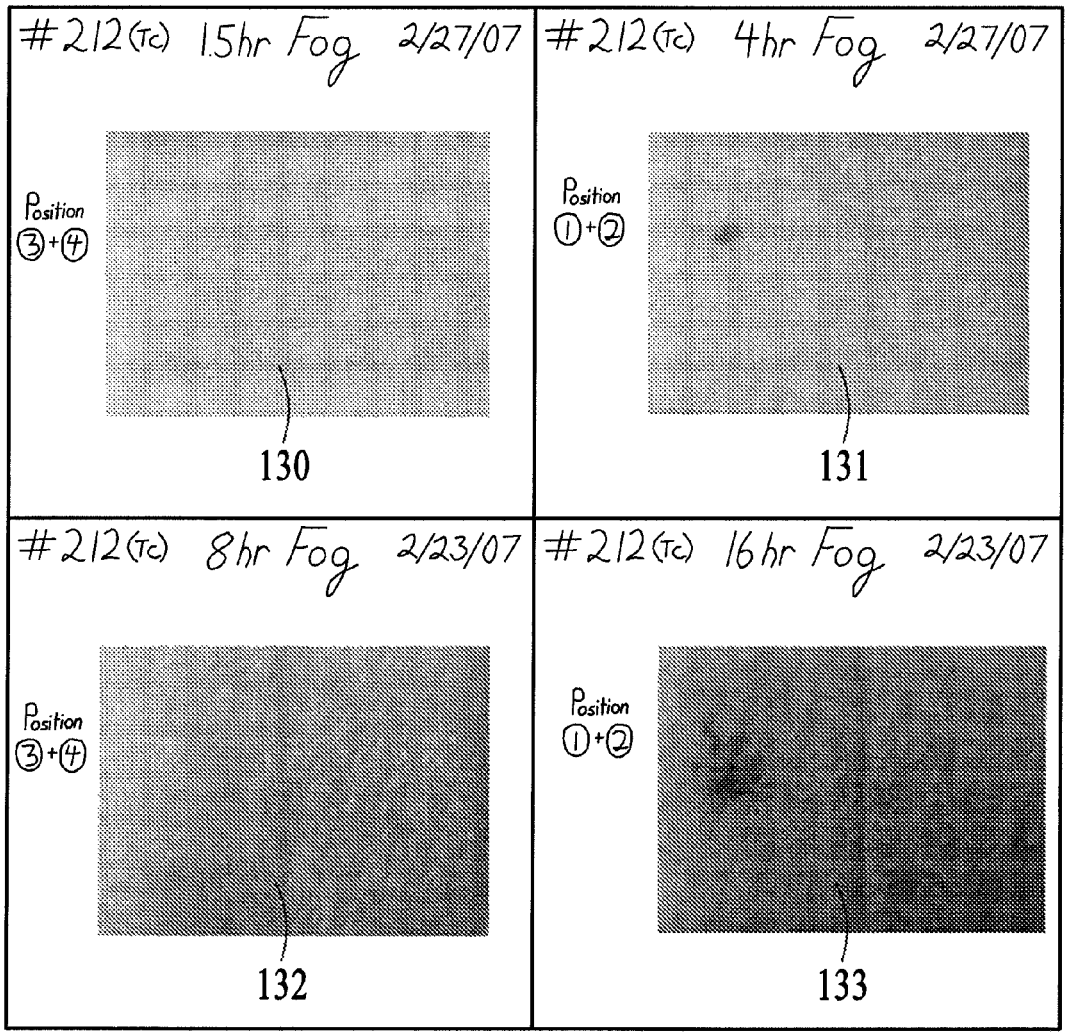
FIG. 12/1

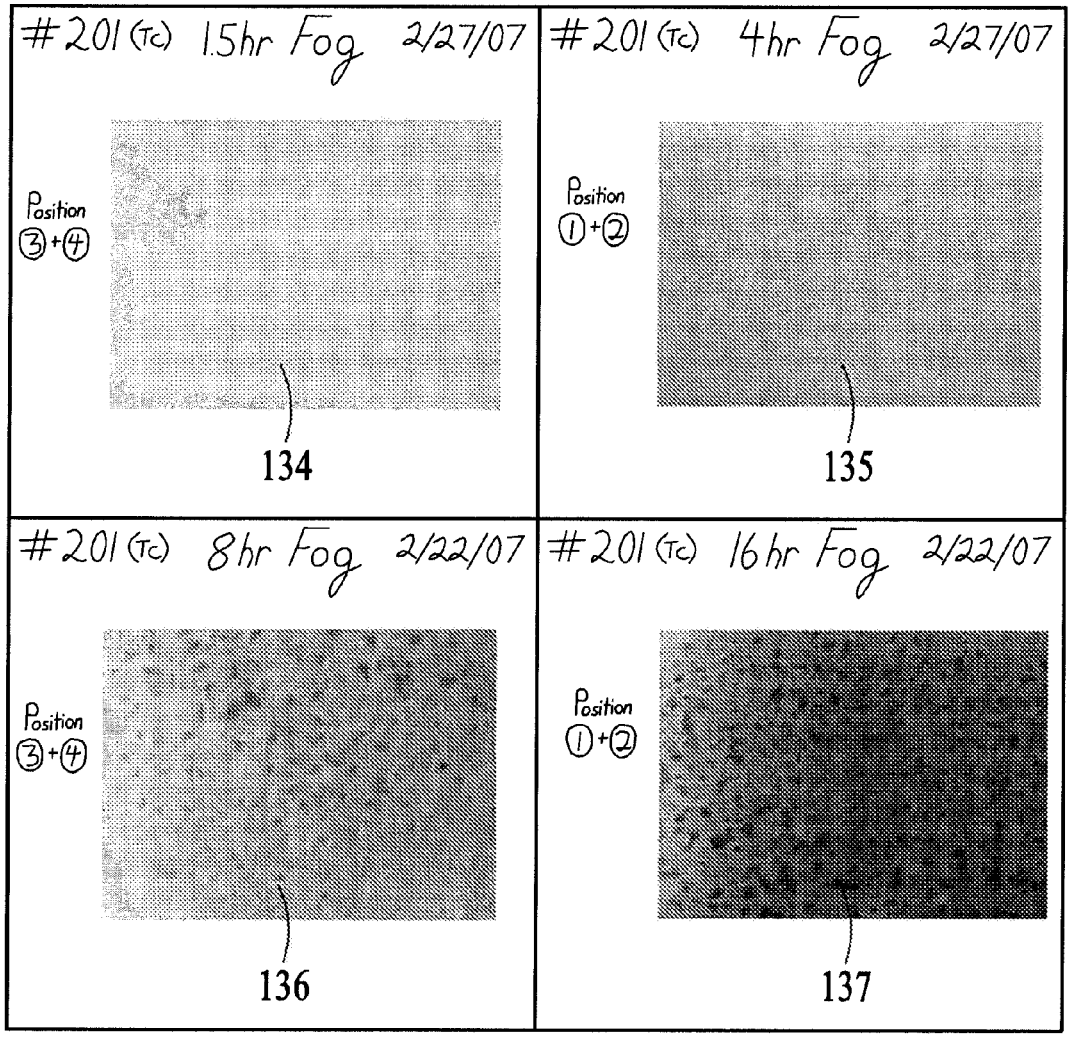
FIG. 12/2

FOGGING FORMULATIONS FOR FIXATION OF PARTICULATE CONTAMINATION IN DUCTWORK AND ENCLOSURES

RELATED APPLICATIONS

This application claims the benefit of U.S. Provisional Patent Application Ser. No. 61/456,001 filed Oct. 28, 2010, and is hereby incorporated by reference.

This invention was made with government support under Contract Number DE-AC07-ID14517 awarded by the United States Department of Energy. The government has certain rights in this invention.

FIELD OF THE INVENTION

A method and an apparatus using aqueous fixatives for fogging of ventilation ductwork, enclosures, or buildings containing dust, lint, and particulates that may be contaminated by radionuclides and other dangerous or unsafe particulate contaminants, which method and apparatus are capable of (1) obtaining full coverage within ductwork and buildings, (2) penetrating and fixing the lint, dust and large particles present in ductwork and buildings so that no airborne particles are released during or after the application of the fixative.

BACKGROUND

The method and apparatus of the present invention is motivated by the need for safe and effective Deactivation and Decommissioning (D&D) of ventilation ductwork, enclosures, and buildings containing dust, lint, and particulates that prevents the release of radionuclides and other dangerous or unsafe particulate contaminants. Numerous examples exist of using fogging techniques to fix radionuclide contamination for a variety of situations. However, these techniques tend to work only on thin layers of contamination, and historically, they have not been effective on large particles such as lint and dust trapped in ducts of interest. The invention described herein is novel and has not been attempted before.

Contamination control is crucial during D&D activities, as well as during modifications to existing systems. In several of the older processing facilities, it is well known that contamination, in some cases substantial contamination, is present throughout the exhaust ductwork due to the years of processing in glove boxes, etc. A critical area of concern during the decommissioning of radioactive facilities is the prevention of the spread of radiological contamination. This is more serious for areas where large accumulations of radioactive dust and lint are present that have the potential to "go airborne", such as disposal site exhumation, laundry facilities, exhaust ventilation ducting and exhaust stacks. In a recent demolition of large ventilation ducting (about 10-ft cross section and 100-ft long) at the US Department of Energy's (DOE's) Brookhaven National Laboratory, a spray coating was applied to the duct from inside using a painter dressed in anti-contamination clothing and an airline respirator system.

A different scenario at the U.S. DOE's Idaho National Laboratory (INL) required that a backhoe operator be placed in a contamination proof, positive pressure cab to prevent airborne contamination. In the case of the Idaho example, the required change of operators (required every two hours due to limitations using positive pressure system), and the anti-contamination clothing alone amounted to thousands of dollars per day.

In another case at the Idaho Site, there were significant accumulations of lint at a radioactive laundry. Traditional methods of capturing the lint prior to decommissioning, like simple glycerin fogging methods, were not successful, because they did not penetrate and bind the lint (see FIG. 1). The duct 1 shown in FIG. 1 is contaminated with lint 2, 3, 4, 5 attached to the wall and needs to remain attached to the wall 1 of the duct 1 during decommissioning. Some of the lint is large 4, 5 and hangs from the walls. The estimated loss of productivity typically exceeds fifty percent on most of the projects when respiratory protection required. These conditions exist in DOE Facilities where airborne contamination mandates the use of costly contamination controls and significantly reduces worker productivity.

There have been attempts of applying a coating in the past. However, these attempts have not been successful in penetrating and adhering contaminated lint and dust to the ductwork. As a result, that contamination was not fixed and ultimately became airborne when it was disturbed. Improved capture coating formulation will penetrate large amounts of lint and dust present in the ductwork and make the lint and dust, and any radioactive contaminants trapped in the lint and dust, adhere to the substrate material to allow ducting to be removed and compacted without spreading contamination. Since a "fog" acts as a gas, it can be introduced into the ductwork at a very low pressure and low velocity and will travel throughout the ducting with only an entry and exit point. The fogging has a number of operational advantages over spraying, which requires a spray hose and nozzle to be inserted and moved along the ducting. The spraying method has the potential of disturbing the contamination during the spraying itself, which depends on the pressure and velocity at which it is implemented.

The current glycerin-based capture coatings are formulated to remain tacky for prolonged periods, allowing any re-suspended contaminant particles to become captured when they contact the surface. However, this coating is formulated only to remove airborne contaminants and will not soak into the lint and dust deposited on the ducting surface. By formulating a new capture coating (containing surfactants and other components) and ensuring the delivery method supplies adequate amounts of the coating, as well as providing adequate coverage of the entire surface area of the ductwork, this new capture coating will reduce or eliminate the requirement for glovebags and extensive contamination control during cutting and removal of ductwork. This control is achieved by fixing the contaminants to the surface of the duct so that the danger of creating airborne contaminants is reduced.

There are a number of technologies that have been used for this application with limited success. They are:

Spraying the fixative into the ductwork Although the fixative could be sprayed into the ductwork, rather than being applied in a fog through the ventilation system, there are several disadvantages with this approach. This method of application might require access to the ductwork in several different locations to obtain full coverage. This would require inserting the spray nozzle/wand and then applying the fixative to the local area. In some instances, the ductwork could be highly contaminated and even though physical access is available, it may not be allowed due to the radioactive field present. Therefore, in those instances of high contamination, the spray method may not be allowed. Once the nozzle/wand is inserted into the ductwork, the potential spread of contamination exists during the removal of the nozzle/wand. This would also require bagging the equipment during removal, and continuous monitoring during the application to assure workers are not contaminated.

Vacuuming/cleaning the ductwork prior to removal. Although this method is used widely in both the residential and commercial sector, it is considered unacceptable for most radionuclide applications. The main reason is because the material that is removed during the vacuuming/cleaning is contaminated. Therefore, a new waste stream has been generated and now must be disposed of properly. Furthermore, a risk of contamination to workers due to radiation exposure and also the potential for the spread of that contamination outside the ductwork exists during the vacuuming/cleaning. In addition, depending on the amount of contamination and the type of contamination, criticality could be an issue due to the method of capture of the contamination and the configuration of that capture device.

Wetting down the inside of the ductwork with water. Again, although this method is widely used in the D&D of facilities to help reduce the potential airborne constituents during massive demolition, this method could also result in an additional waste stream, and the potential for increased airborne contamination during the application of the water depending on the quantity and method of the water applied. Also, depending on what contaminants are present in the ductwork, introducing water to some of those contaminants could result in severe chemical reactions. Those reactions could include an over-pressurization of the system, explosion, or fire. Furthermore, for those instances where a modification is being made to the system, rather than demolition of the entire system, the addition of water into the ductwork is unacceptable due to the numerous adverse affects of that water into the ventilation system and components (e.g., HEPA filter wetting).

A combination technique involving fogging and coating of contaminants. A combination technique was used successfully at the East Tennessee Industrial Park on the decommissioning project in Irwin, Tenn. Fogging was used to reduce contamination and spraying was used to coat and lock the contaminant in place.

The invention proposed herein addresses the deficiencies of and greatly enhances the performance of fogging methods in terms of reducing or eliminating contamination and increasing worker safety, particularly where capture coatings are to be fogged into dusty areas and ductwork. While testing has been performed to prevent the generation of airborne radioactive contamination, none dealt directly with the problem of penetrating significant quantities of dust and lint, and then capturing them in one step. A fog behaves similar to a gas. As a consequence, it can be introduced into ductwork at low pressure and low velocity. The approach was to use a more sophisticated solution containing a sticky base and a surfactant to increase the penetration and capture of dust and lint. A wide range of laboratory tests were conducted with the following criteria to improve the fogging fixative:

ability to produce a fog, ability to penetrate a consistent simulated lint coupon, ability to maintain a sticky surface over a period of hours, ability to wet the surface of the lint/dust, and ability to prevent dust generation after dry.

The fogging technology has the potential to be applied across a variety of industries.

DOE Decontamination. Several DOE site facilities throughout the United States that supported the Cold War and other research type missions are currently going through the decontamination process. As was the case for the commercial applications, the solution developed can be applied into the ventilation system, pipes, and rooms to fix contamination that has accumulated over years of operation at these facilities. The contamination can be both nuclear, as well as chemical. In either case, airborne release that occurs when the contamination is disturbed is a concern. Again, since the fogging method of this invention can be done remotely, the exposure of the worker to the contamination is eliminated. Also, since the key to the fixative solution described herein is the capability to penetrate and then fix the contamination at a very low pressure and velocity, this separates it from the other type fogging processes currently being used.

Commercial nuclear industry. Some commercial nuclear plants have been shut down and de-commissioned. During the decommissioning phase, contamination control is crucial. Whether it be dismantling of contaminated ductwork, piping, or rooms, the control of airborne contamination is necessary to assure the spread of the contamination does not occur. In almost all instances today, workers manually apply some type of fixative in an attempt to control the spread of contamination. In some cases, this works very successfully; however, since the application is being applied manually, exposure risks are a concern from a safety standpoint. Also, in some instances, the fixative does not penetrate the contamination completely. As a result, once the contamination is disturbed some of that contamination still becomes airborne. Without having some type of means to penetrate the contamination and to ensure it is fixed to the material, the spread of that contamination is inevitable. With the new fogging method of this invention, having the capability to penetrate the contamination allows the dismantling of the facility in a quicker and safer manner. In addition, the new fogging solution described herein can be applied remotely without the need for manual application, eliminating the exposure safety concern.

Chemical plant demolition. There are several chemical plants throughout the world generating chemicals either as a by-product during the operation of the facility, or as the main product of production. In either case, when the plants are shut down, for any reason, demolition of the facilities is necessary. As is the case in all these examples, fixing the chemical agents to the ductwork, pipe and walls becomes crucial in eliminating the potential airborne release of these chemical agents once they are disturbed. In some instances, the buildup during the years of operation of these facilities could be significant. As a result, the capability to penetrate into the agent to ensure it is fixed and to perform this remotely without jeopardizing exposure concerns is a must. The fixative solutions described herein have this capability and could prove to be a key contributor in eliminating airborne releases in many different applications.

Asbestos abatement One of the major concerns with asbestos is the small fibers becoming airborne and entering the lungs. The new fogging described herein could be applied into a room where asbestos is located. The solution would penetrate into the surface of the asbestos and would not allow the fibers to become airborne. Thus, creating a shell type configuration preventing the release of the asbestos fibers and allowing the removal of the asbestos under safer conditions. In some instances, paint is applied to the asbestos to create a similar type of configuration. However, the current method of application of the paint still requires workers to be in the room during the application, whether it be sprayed on to the surface of the asbestos, or applied by hand. Either way, manned entry is necessary. With the fixative solutions described herein, a fog could be applied to the room, even focusing the application to the specific area remotely. Again, this limits the exposure concern.

National Security Building Decontamination Support. In the event of a terrorist act, where an agent of some type (chemical or radiological) is introduced into a building through the ventilation system, the fogging solution described herein could be applied into the building ventilation system, to penetrate, capture and fix the agent to the surface. At that time, decontamination efforts can commence in a safer environment without the concern of further spread of the agent through the building or outside of the building. Thus, this eliminates the exposure risk to the workers performing the decontamination, and also, to the general public near the building. In addition, if the agent introduced did spread throughout the building and the building was a complete loss, the solution could be applied through the ventilation system into the building also penetrating, capturing and fixing the agent to the building surfaces. This would eliminate any airborne contamination from spreading during the building demolition.

Naval Decommissioning. Again, this technology can be used throughout the Naval decommissioning process, in the event various types of contamination has occurred, to fix contamination to the surface to allow for a safer and faster type of dismantling. Since it can be applied remotely at low pressures and velocities, it will eliminate the exposure of the worker and also the spread of contamination during the application of the solution.

The proposed invention described herein, mainly using latex paint as one of the constituents of the aqueous fixative solution, while very simple, has not been used before. It will result in a more efficient industrial process, eliminate the need to pre-sweep or vacuum exhaust ducts, thus reducing waste, minimize the potential spread of contamination, minimize the need costly anti-contamination protective equipment for workers, and increase worker productivity.

SUMMARY OF THE INVENTION

It is the object of this invention to provide a method and an apparatus for fogging ventilation ductwork, enclosures, rooms, or buildings containing dust, lint, and particulates with aqueous fixatives that will prevent or reduce the amount of lint, dust, and large particles released as airborne particles during or after the application of the fixative.

It is another object of this invention to provide aqueous fixative solutions that will fog, wet, penetrate, and bind lint, dust, and particulates within ductwork, enclosures, or buildings.

The method and apparatus of the preferred embodiment of the present invention is to use an aqueous solution comprised of Ammonium Lauryl Sulfate (ALS), sodium lauryl sulfate (SLS), glycerin, and latex paint that can be used to fog ductwork, enclosures, rooms, or buildings with a coating that will wet, penetrate, and bind large amounts of lint, dust, or particulates residing in the structures to the substrate material and prevent or minimize the release of airborne particulates containing radionuclides or other dangerous or unsafe contaminant particulates during or after the application of the fixative. This solution is comprised of a surfactant to aid wetting and penetration of the lint and dust, a binder to stabilize loose or respirable particles, and an agent to aid in fogging and enhance adhesiveness. Since a fog behaves similar to a gas, it can be safely introduced into ductwork at low pressure and low velocity. The addition of latex paint greatly improves the performance of the fogging solutions used presently in these applications. The initial application of this invention is for the safe removal and compaction of ductwork containing radionuclides during D&D operations without spreading airborne contamination.

IN THE DRAWINGS

FIGS. 12/1 and 12/2 show the coverage of coupons for the Fogging Solution (#212) used in the test (top) and for the conventional solution (bottom) in a laboratory fogging test obtained at 1.5 h (same as test box), 4.0 h, 8 h, and 16 h after fogging began.

DESCRIPTION OF THE PREFERRED EMBODIMENT

The method and apparatus of the present invention is motivated by the immediate and ongoing need to decommission DOE facilities, which may have ductwork, enclosures like hot cells, and buildings that may be contaminated with radionuclides or other dangerous or harmful chemicals.

Figure 1:
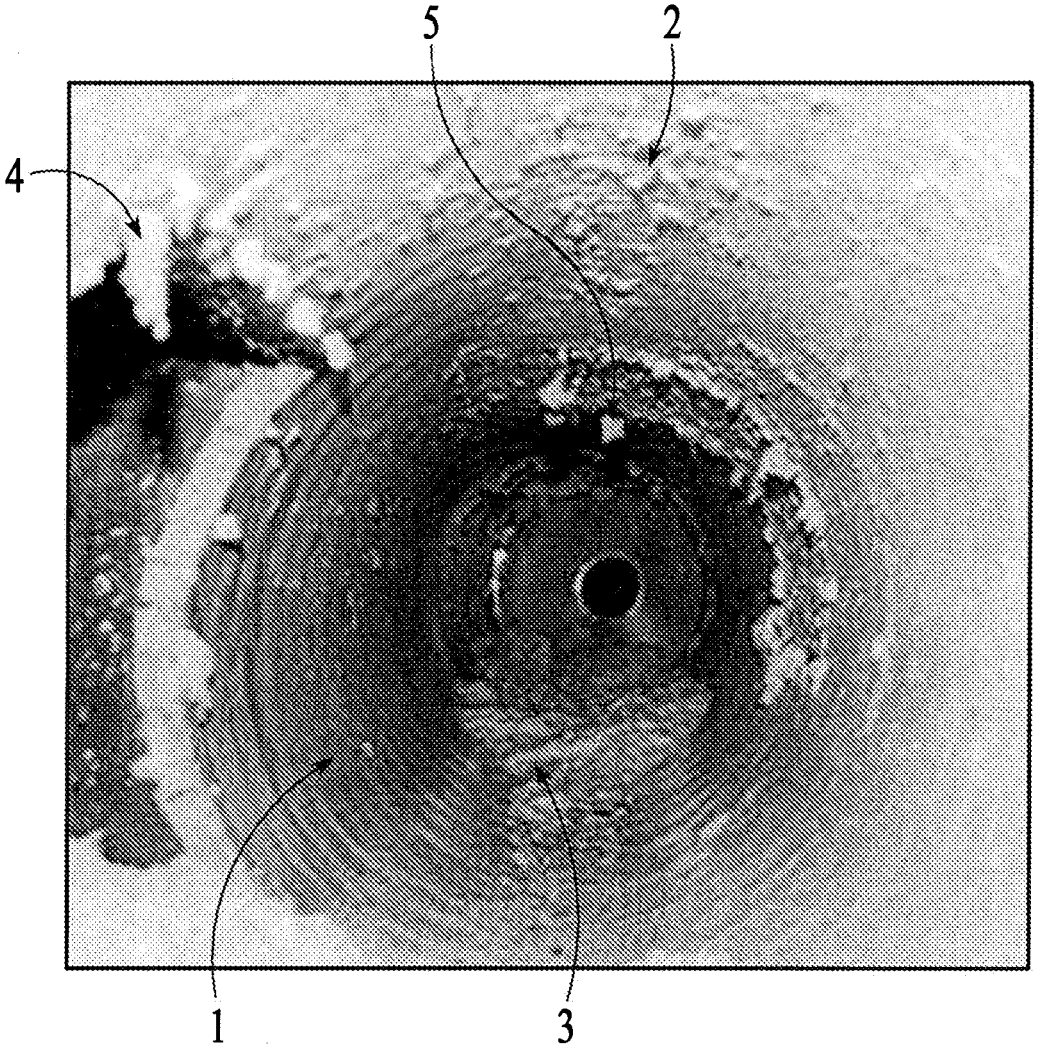
FIG. 1 illustrates the presence of excessive lint in ducting.
Figure 2:
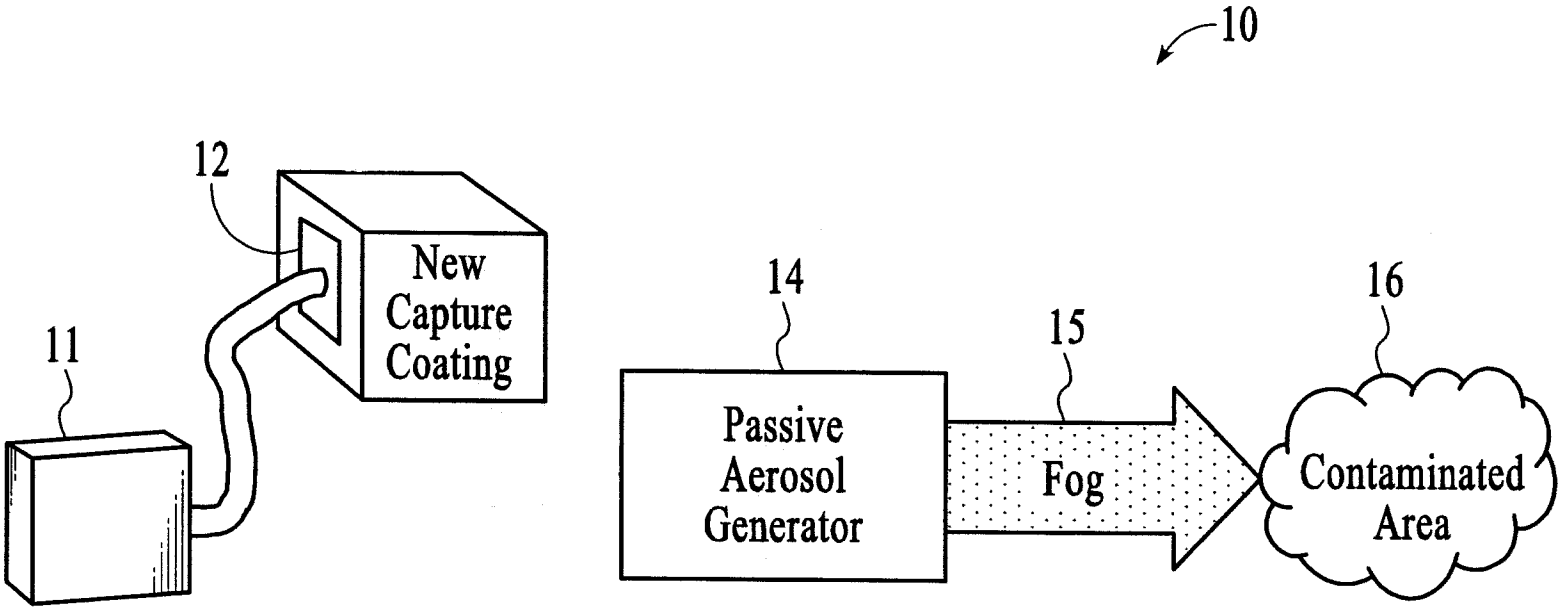
FIG. 2 shows a Passive Aerosol Generator (PAG) and schematic of the proposed fogging method.

The purpose of fogging is to penetrate and coat the dust and lint present in the duct to minimize the airborne contamination released during D&D activities. FIG. 2 illustrates commercially available industrial fogging equipment called a Passive Aerosol Generator (PAG). In FIG. 2, an overview 10 of the fogging approach is illustrated. The PAG 11 is shown set up to fog a potentially contaminated enclosure 12 using a fogging solution. The fogging solution is used by the PAG 14 to go as a fog 15 to the contaminated region of interest 16.

The PAG shown uses kilowatt-sized ultrasonic transducers to generate a fog in the ductwork. This equipment was used to evaluate the new aqueous fixatives described herein.

Laboratory Tests of Fogging Solutions. A series of laboratory tests were performed to develop new formulations for the capture coatings using sophisticated binders and surfactants that perform better than the representative baseline coatings for penetrating dust, lint, and other particulates. Different surfactants, binders, and other components were tested on laboratory samples of lint, dust, and simulated contamination independently and in combination.

Figure 3:
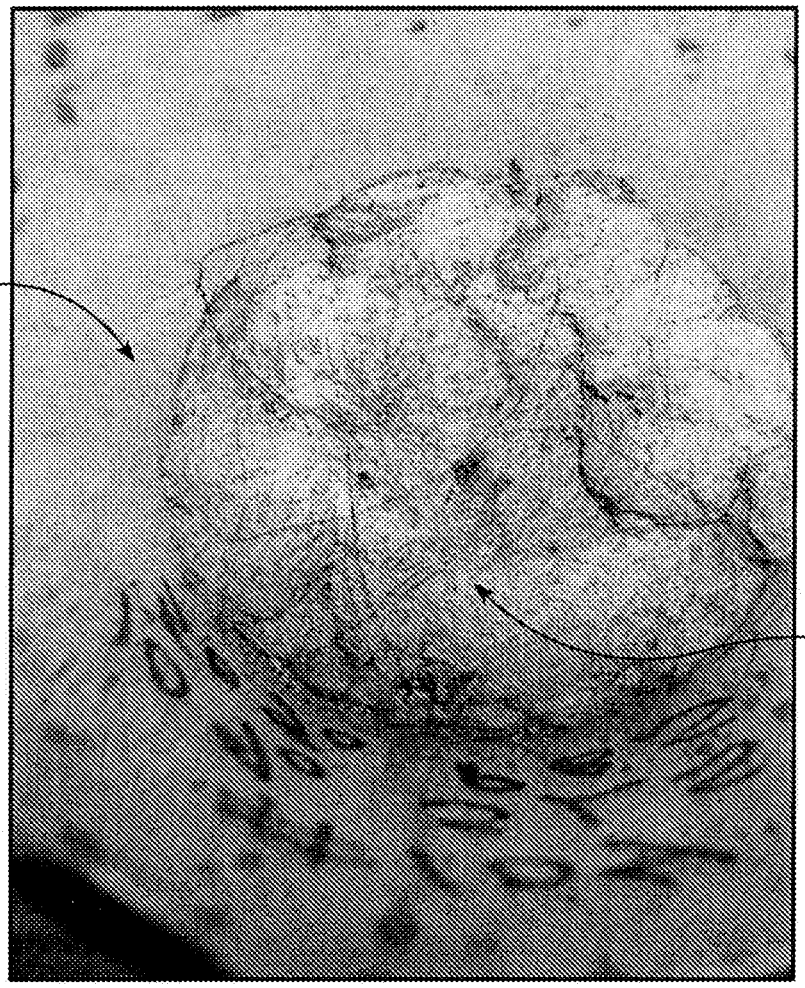
FIG. 3 shows a lint pad covered with a Polymeric Barrier System (PBS) coating used in the laboratory spraying tests.

Initial scoping studies consisted of spraying many different types of these solutions onto pads of lint contained in plastic beakers from a height of 20 inches. The distance and amount of spray (via number of pumps) were held constant. FIG. 3 shows the results of one of these tests in which a lint pad 20 was coated with a binder called polymeric barrier system (a proprietary formula by Bartlett Services, Inc., with trade name PBS) 21. The purpose of these tests was to determine whether or not the solutions were able to capture and contain dusty lint-type contaminants. Metrics used to evaluate these tests included the ability of the solution to penetrate the top layer of lint, contain dust, and generally bind the material. Based on the results of these simple spray tests, the solutions with promising characteristics underwent further evaluation in the laboratory using a fogging test apparatus. Some solutions, like a polyvinylbutyral strippable coating (a proprietary formula called Stripcoat TLC™ by Bartlett Services, Inc.) (#101), were not stable in solution with surfactants and did not perform beyond initial tests. Table 1 shows the results of some single chemical (double digit) and combined chemical (triple digit) tests. Tables 1 and 2 show the results for some of the solutions used in the fogging tests.

Figure 4:
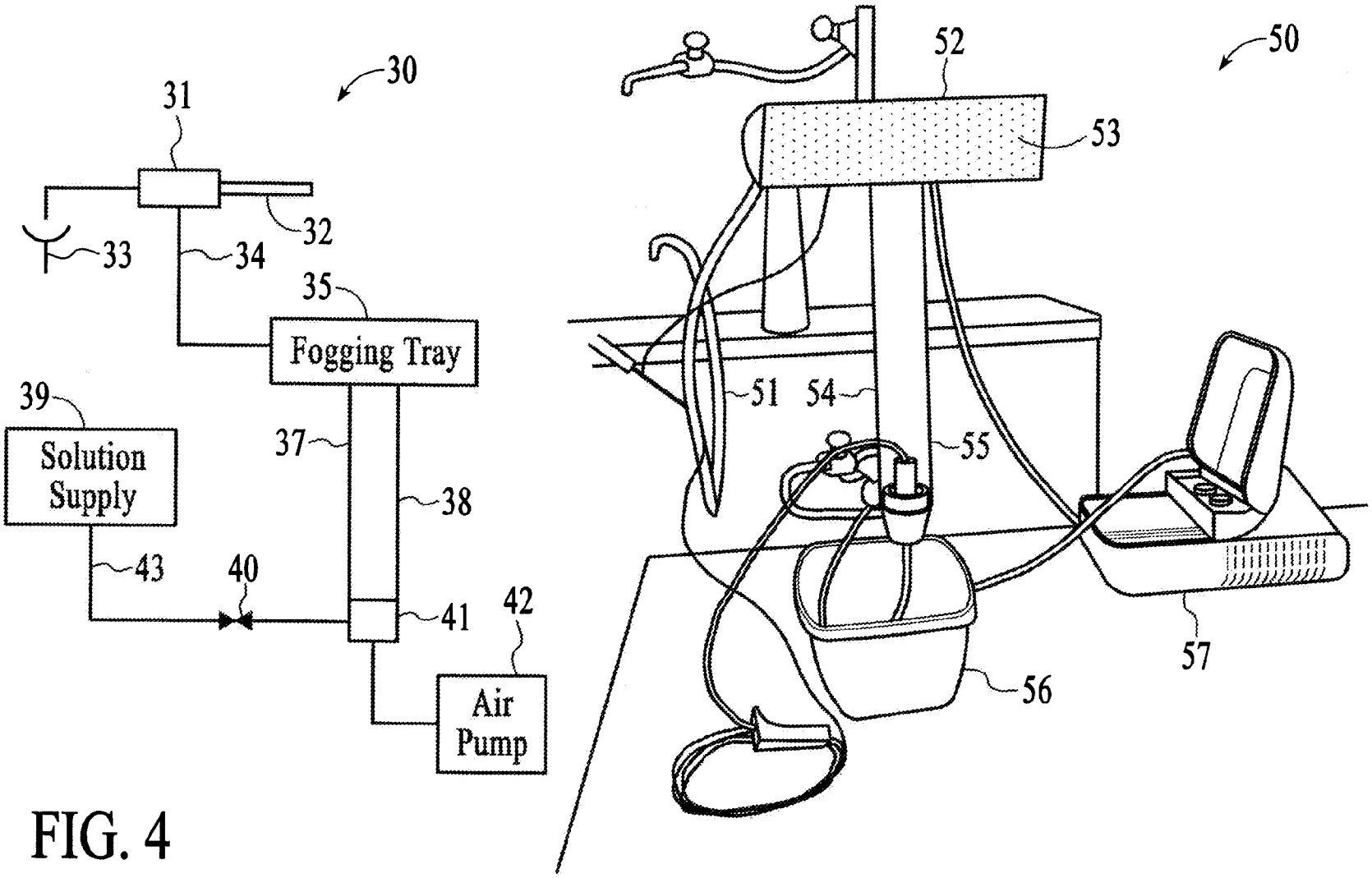
FIG. 4 shows the nebulizer fogging apparatus used in the laboratory to evaluate the fogging and coverage obtained from different aqueous fixative solutions.

A pneumatic nebulizer, which is used in inhaler devices in the medical industry, was then used to simulate in the laboratory an industrial fogging method during the evaluation of the most promising fixative solutions. FIG. 4 shows a schematic of the pneumatic nebulizer fogging apparatus 30 used in the laboratory tests, and a layout of the apparatus 50. The aqueous fogging solution 39 is allowed to enter the nebulizer at a set rate through the plastic tubing 43 using the throttle valve 40. The air pump 42, 57 is attached to the nebulizer 41 and a fog 38, 55 is produced in the acrylic tube 37, 54 connected to the fogging tray 35, 52. The fog 55 entering the tray 35, 52 will coat the laboratory coupon pad 53. The water jet educator 31 takes the excess liquid from the tray 35, 52 and the off-gas line 34, 51 and deposits the excess liquid in the container 33.

TABLE 1

Presentation of Some of the Laboratory Test Results

| | Wetness | | Stickiness | | Dustiness | | Penetration | |
|---|---|---|---|---|---|---|---|---|
| Solution | initial | final | initial | final | initial | final | initial | final |
| #11 (50% Mod Podge) (spray test) | • | ⊙ | ⊙ | ⊙ | ⊙ | ⊙ | ○ | ○ |
| #12 (50% LP) (spray test) | ⊙ | ○ | ○ | ○ | ⊙ | ⊙ | ○ | ○ |
| #101 (10% ALS/50% TLC)* | • | ○ | ⊙ | ○ | ⊙ | ⊙ | ○ | ○ |
| #102 10% ALS/50% PBS)* | • | ○ | • | ○ | ⊙ | ⊙ | ○ | ○ |
| #103 (10% SLS/50% TLC)* | • | ⊙ | • | ⊙ | ⊙ | ⊙ | ○ | ○ |
| #104 (10% SLS/50% PBS)* | • | ⊙ | • | ⊙ | ⊙ | ⊙ | ○ | ○ |
| #105 (5% SLS/50% Mod Podge)* | ⊙ | ○ | ⊙ | ○ | ⊙ | ⊙ | ○ | ○ |
| #106 (10% ALS/50% LP)* | ⊙ | ○ | ⊙ | ○ | ⊙ | ⊙ | ○ | ○ |
| #107 (10% Silvex/50% PBS)* | ⊙ | ○ | • | ○ | ⊙ | ⊙ | ○ | ○ |
| #109 (0.5% SLS/2% PBS)* | ⊙ | ○ | ⊙ | ○ | ○ | ○ | ○ | ○ |
| #110 (5% ALS/6% Mod Podge)* | ⊙ | ○ | ○ | ○ | ○ | ○ | ○ | ○ |
| #111 (5% ALS/5% LP)* | ⊙ | ○ | ⊙ | ○ | ○ | ○ | ○ | ○ |
| #112 (50% Applebright)* | ○ | ○ | ○ | ○ | ⊙ | ⊙ | ○ | ○ |
| #113 (3% Glycerin)* | ○ | ○ | ○ | ○ | ⊙ | ⊙ | ○ | ○ |
| #114 (14 Glue/6% ALS)* | ⊙ | ○ | • | • | ⊙ | ⊙ | ○ | ○ |
| #115 (9% ALS/15% Posifix)* | ⊙ | ⊙ | ⊙ | ○ | ⊙ | ⊙ | ○ | ○ |
| #201 (baseline glycerin) 8 hr | ⊙ | ⊙ | ○ | ○ | ○ | ○ | ⊙ | ⊙ |
| #202 (7% ALS, 20% PBS) 8 hr | ⊙ | ○ | ⊙ | ○ | ○ | ○ | ⊙ | ⊙ |
| #203 (7% ALS, 20% LP) 8 hr | ⊙ | ○ | ⊙ | ⊙ | • | • | • | • |
| #204 (5% SLS/10% Latex, 10% Gly) 8 hr | ⊙ | ○ | ⊙ | ⊙ | ⊙ | • | • | • |
| #206 (7% ALS, 5% GLY, 5% LP) 8 hr | ⊙ | ○ | ⊙ | ⊙ | ⊙ | • | • | • |

Acronyms are provided below.
No change = ○,
Improvement = ⊙,
Best result = •,
*fogging results for 4 hours
Wetness = beading on surface compared to water (initial wetting best, final (dried) wetting not necessary),
Stickiness = adhesion between thumb and forefinger,
Dustiness = flick with finger under light,
Penetration = solution penetrates well into lint (in best case through coupon)

TABLE 2

Results of the Nebulizer Laboratory Tests

| Sample | Solution | Wetness | | | Stickiness | | | Dustiness | | | Penetration | | | Notes | Date |
|---|---|---|---|---|---|---|---|---|---|---|---|---|---|---|---|
| 2 hr | #201 | 1 | 1 | 0 | 0 | 0 | 0 | 2 | 2 | 2 | 0 | 0 | 0 | Oily Easy to "meter" | Jan. 30, 2007 |
| 8 hr | (Baseline) | N/A | 1 | 0.5 | N/A | 0 | 0 | N/A | 0.5 | 0.5 | N/A | 2 | 2 | | |
| 2 hr | #202 | 0 | 0 | 0 | 0 | 0 | 0 | 2 | 2 | 2 | 0 | 0 | 0 | After 2 has of spraying, 2 hr | Jan. 29, 2007 |
| 8 hr | | N/A | 1 | 0 | N/A | 1 | 0 | N/A | 1 | 1 | N/A | 1 | 1 | sample was dry to touch | |
| 2 hr | #203 | 1 | 0 | | 0 | 0 | | 2 | 2 | | 0 | 0 | | Easy to "meter" | Feb. 1, 2007 |
| 8 hr | | N/A | 1 | | N/A | 0 | | N/A | 0 | | N/A | 1 | | | |

TABLE 2-continued

Results of the Nebulizer Laboratory Tests

| Sample | Solution | Wetness | | | Stickiness | | | Dustiness | | | Penetration | | | Notes | Date |
|---|---|---|---|---|---|---|---|---|---|---|---|---|---|---|---|
| 2 hr | #204 | 1 | 0.5 | 0 | 0.5 | 0 | 0 | 2 | 2 | 2 | 0 | 0 | 0 | Dry but oily (2 hr sample at | Jan. 31, 2007 |
| 8 hr | | N/A | 1 | 0 | N/A | 0 | 0.5 | N/A | 0.5 | 0 | N/A | 1 | 2 | T = 8 hrs) Easy to clean-up | |
| 2 hr | #205 | | | | | | | | | | | | | | |
| 8 hr | | | | | | | | | | | | | | | |

Figure 5:
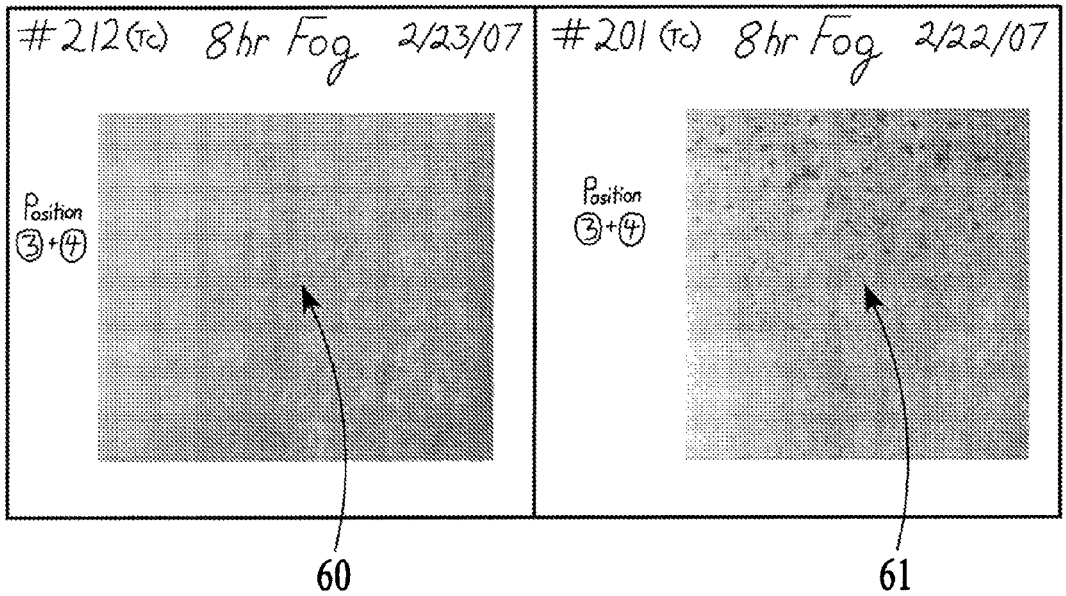
FIG. 5 shows felt coupons after simulating fogging in the laboratory for 8 h with the new fogging solution #212 and the baseline (i.e., the conventional) fogging solution #201.

Wetness => Compared to water
Stickiness => small amount between thumb and forefinger
Dustiness => flick with finger under light (0 means no dust)
Penetration => "0" means solution does not penetrate upper felt
Penetration => "1" means solution penetrates upper felt
Penetration => "2" means solution penetrates base of felt leaving colored spots on white card The results are presented and discussed below. For reference the Baseline/Conventional Fogging Solution was died red. The Fogging Solution #204 was died blue and the Fogging Solution #212 was dyed yellow. In FIG. 5, the results for fogging solutions, #206, demonstrated improved performance over the glycerin baseline fogging material (#201). (Note that Solutions #212 and #206 are similar.) This can be seen by comparing the coverage of the coupon 60 with fogging solution #206 and the coverage of the coupon coverage 61 with fogging solution #201. These new fogging solutions contain a surfactant to aid wetting and penetration of the lint and dust, a binder to stabilize respirable particles, and an agent to aid in fogging and enhance adhesiveness. Based on these tests, which compared the following properties, wetness, stickiness, dustiness, and penetration, it became clear that there are a number of improved fogging capture coatings that outperform the glycerin baseline fogging agents being used operationally today. These coatings contain a surfactant intended to improve wetting of the lint and dust, a binder to stabilize loose particles, and an agent to aid in fogging and enhance stickiness. More importantly, all of the chemical additives are composed of common materials found in paint and shampoo, and none are considered harmful or hazardous (beyond being irritants in higher concentrations). The solutions are aqueous and generally clean up with soap and water. They show superior penetration into lint coupons exposed in the fogging system and contain talc dust (added to the coupons prior to fogging) much better than the baseline solution. In fact, no talc dust can be seen on the lint coupons treated with the two candidate solutions.

Figure 6:
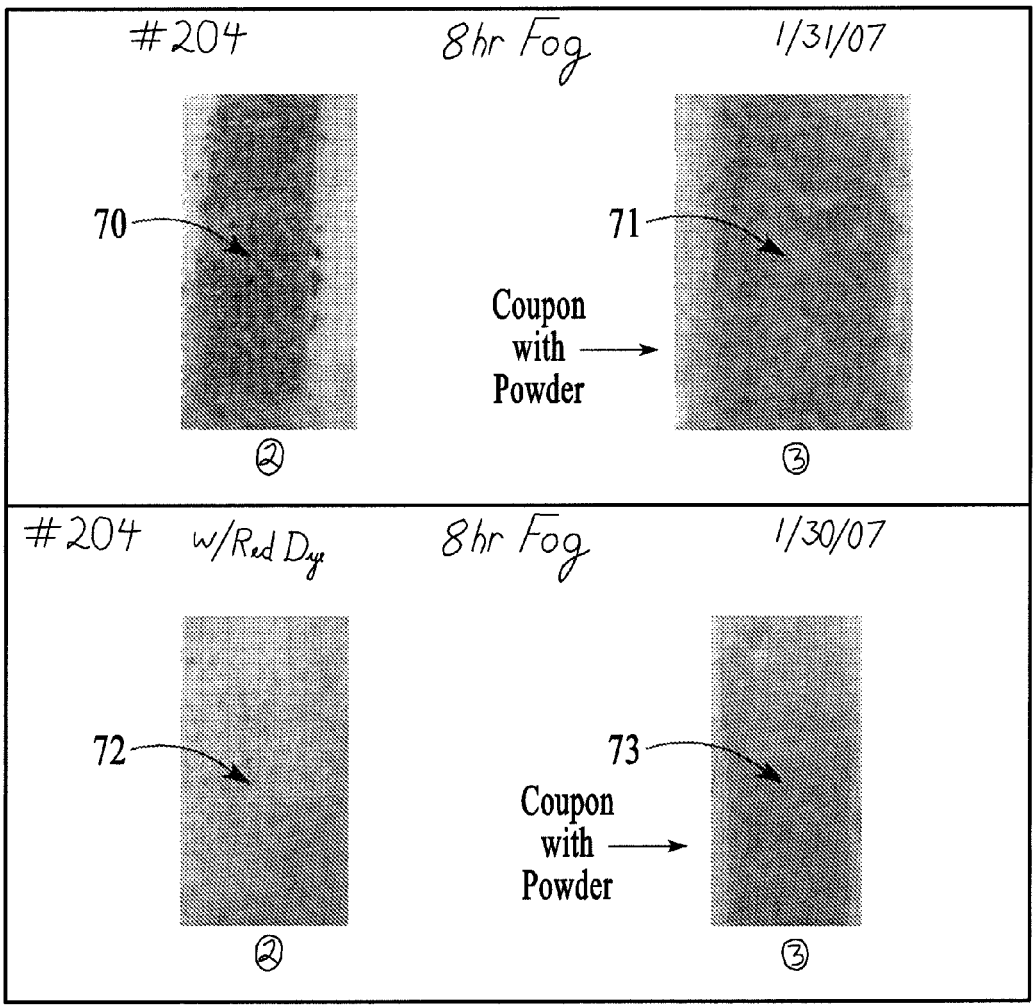
FIG. 6 shows felt coupons #204 and baseline.

FIG. 6 shows four felt sample coupons 70, 71, 72, 73 after fogging for eight hours. Two of the coupons 70, 71, one covered initially with talc powder 71 and one not covered with talc 70, showed the results for fogging solution #204. The other two coupons 72, 73, one covered initially with talc powder 73 and one not covered with talc 72, showed the results for the glycerin baseline fogging solution #201. The test results show superior penetration into both blue coupons, where the blue-colored coupon was fogged with solution #204 containing blue dye, and the red-colored coupon was fogged with the baseline agent containing red dye. Additional coupons were covered with a powder 71, 73 prior to fogging to simulate dust. After fogging the coupons for 8 h, those covered with powder and fogged with these solutions were able to contain dust much better than the baseline solution.

Figure 7:
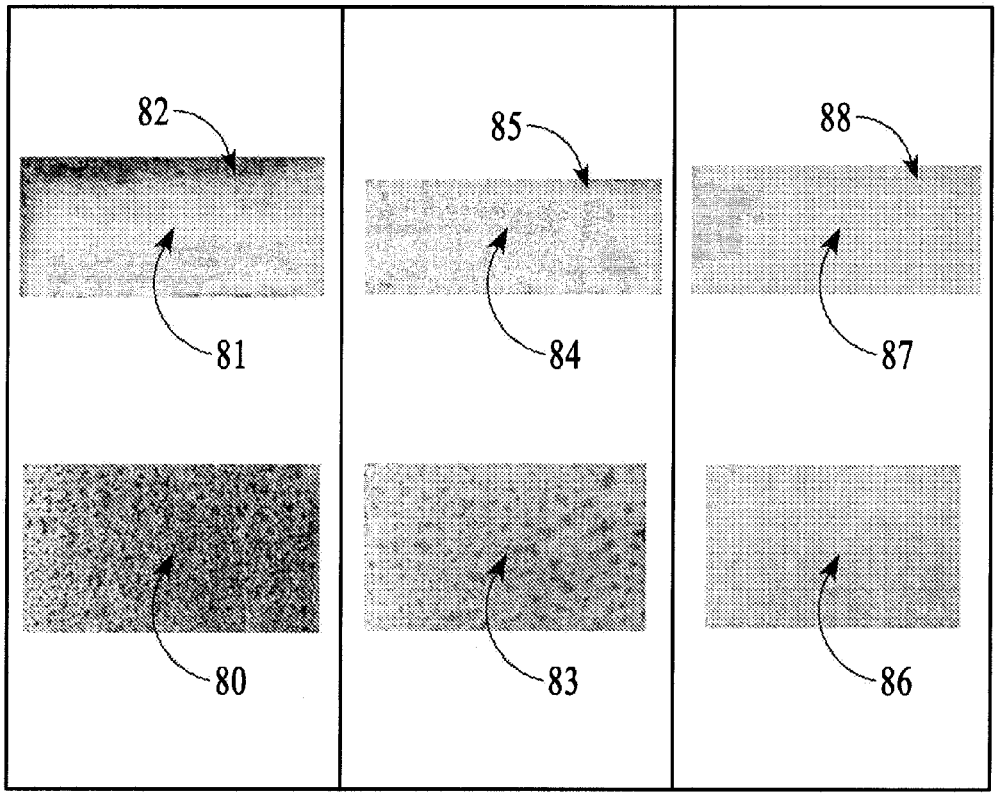
FIG. 7 shows the side and face views of the batting coupons for solution #207, the baseline solution #201, and solution #212.

Additional penetration testing was performed to evaluate the absorption characteristics of the new formulations. FIG. 7 shows the results of fogging for 16 hours for solutions #204 (blue) 80, 81, 82 and #212 (yellow) 86, 87, 88 versus the baseline solution of #201 (red) 83, 84, 85. The test results showing a side view of the coupons 81, 82, 84, 85, 87, 88 reveal improved penetration characteristics of the new formulations. The penetration depth for solution #207 (blue) 82 can be seen on the side view 81 of the coupon. The penetration depth for solution #212 (yellow) 88 can be seen on the side view 87 of the coupon and it has better cover than either of the other two fogging solutions. The penetration depth for the glycerin baseline solution #201 (blue) 85, which can be seen on the side view 84 of the coupon, is very poor compared to solutions #212 and #207. The coverage can also be seen in the top views of the coupons 80, 83, and 86, where solution #212 (yellow) 86 exhibits the best coverage. Fogging solution #207 (blue) also has better coupon coverage 80 than the baseline solution #201 (red) 83. Additionally, unlike the baseline solution shown in red, which maintains an oily surface, a crusty layer forms on the top of the coupon fogged with the enhanced solutions. This crusty surface inhibits the release of any foreign particles into the air. These results are conservative, because the samples shown were made of a batting material used for pillows and lawn furniture that is water resistant.

Fogging Test in a Waste Container.

On 26 Feb. 2007, the Idaho National Laboratory (INL) performed a fogging test in a 6-ft by 6-ft by 4-ft waste container 90 as a precursor to fogging a small hot cell and agreed to use our Fogging Solution #206, which was named #212 for these tests, vice a traditional glycerin fogging solution. A 4- to 8-h test was planned, but had to be cut short to 1.5 h. This was the first test of the new fogging solution used with full-scale fogging equipment 91 in a large container. Because of our ad hoc participation, no attempt was made to optimize the fogging operations. The solutions were not optimized for use in the commercial fogging equipment, but the results of this pilot scale test showed (1) that the solution was able to fog and (2) that the fogging was able penetrate the lint coupons placed in the waster container. As will be discussed, further laboratory testing of this solution at 1.5 h, 4 h, 8 h, and 16 h with the nebulizer confirmed the shortened pilot scale test results and showed that the longer periods produced excellent penetration and capture.

Figure 8:
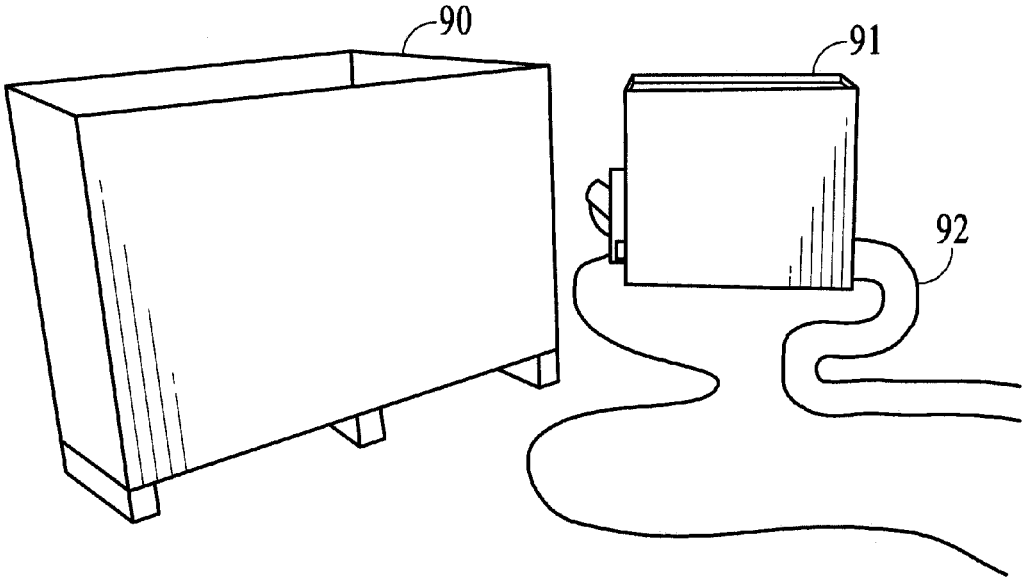
FIG. 8 shows the waste container (left) and fogging apparatus (right) during test preparations.
Figure 9:
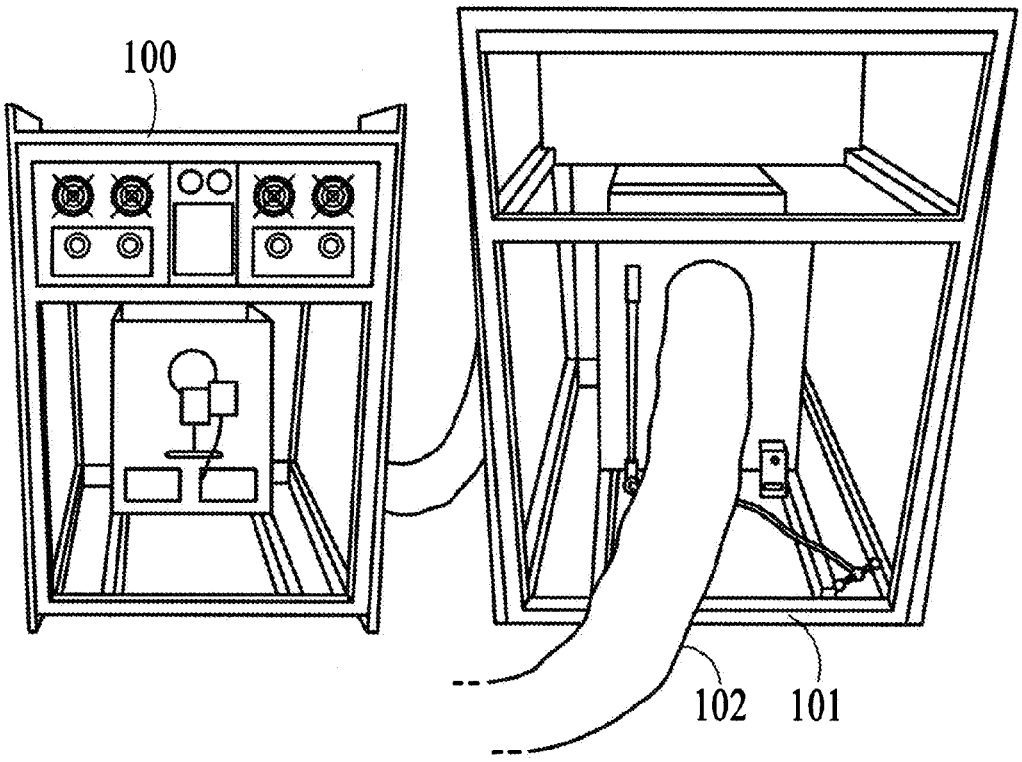
FIG. 9 shows the front and back views of the fogging apparatus used in the waste box test.
Figure 10:
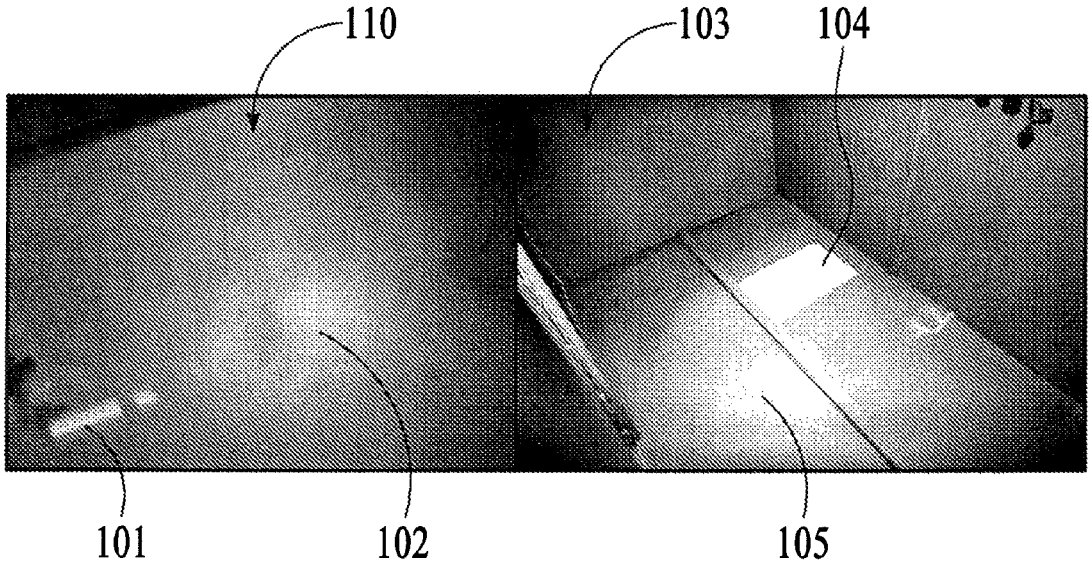
FIG. 10 shows a photograph of the fogging occurring during the test (left), and the bottom of the inside of the test box after the test coupons in the cardboard box have been removed.

FIG. 8 shows the fogging apparatus and waste container (free of any contamination for these tests) used in the pilot scale testing during test setup. FIG. 9 shows the front 100 and the back 101 of the fogging apparatus with the flexible duct 102 that connects to the enclosure requiring fogging. FIG. 10 shows the fogging that occurred during the test, as viewed from a window, in the waste container 110, 103. This figure also shows the location of the fabric coupons 104 that were placed on a box on the floor and removed after the test was completed. One of the ultrasonic transducers used to develop the fog 101 is shown. The coverage can be seen from the yellow coating 102, 105 versus the white area 104 where the coupon box was removed.

Figure 11:
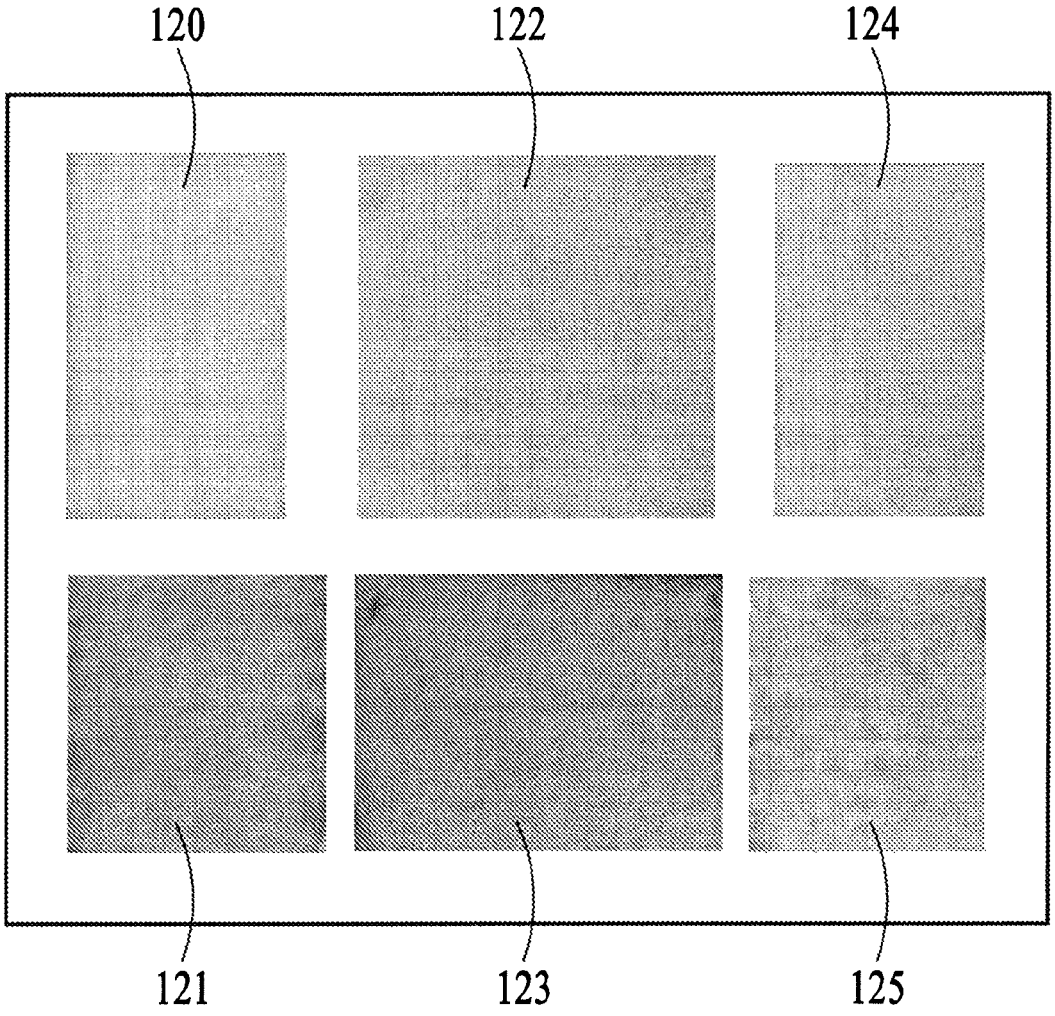
FIG. 11 shows a photograph of the coupons obtained before (top) and after (bottom) the 1.5-h test.

FIG. 11 shows the coverage of the coupons before (top) 120, 122, 124 and the coupons after (bottom) 121, 123, 125 that were placed on the floor of the waste container as illustrated in FIG. 10. Even after only 1.5 h, which was significantly shorter than the planned duration of the test, the fogging solution penetrated and covered the coupons. For comparison purposes, we conducted a special laboratory test with Fogging Solution #212 (top; yellow) and the baseline solution (bottom; red) to determine the penetration and coverage after only 1.5 h versus the 4-, 8- and 16-h tests coverage. The results of the laboratory tests shown in FIG. 12 indicate that the coupons would be penetrated by the solution, as indicated in the waste container test, but at longer duration than 1.5 h. The coupon results for the fogging solution #212 (yellow) at 1.5 h 130, 4 h 131, 8 h 132, and 16 h 133 are shown in the figure. The coupon results for the glycerin baseline fogging solution #201 (red) at 1.5 h 134, 4 h 135, 8 h 136, and 16 h 137 are also shown in the figure. It is clear from the coating intensity, as illustrated by the yellow and red colors, that the fogging solution #212 (yellow) outperformed the glycerin baseline solution #201.

As illustrated in the pilot scale testing, the fogging solutions developed from the laboratory tests can be implemented operationally using commercially available fogging equipment. Two different types of fogging equipment were used in our laboratory and field tests. Current commercial passive aerosol generating (PAG) equipment utilize large ultrasonic transducers (see FIGS. 2 and 9). These are very effective with low viscosity, low solids composition chemistries but are not good at higher ranges. However, we found that higher solids compositions were better at capturing the contamination. Other types of fogging equipment, like a pneumatic nebulizer system, are more effective at those types of solutions. Other types of equipment are available, like fogging cannons.

Over 50 fogging formulations were developed and tested in the laboratory and compared against the conventional glycerin baseline formulation called solution #201 in our tests. Of these, three are particularly noteworthy and were described herein as fogging solution #206, which is very similar to solution #212, and solution #203. Solution #204 was also found to be effective. Fogging solution #212 was used in a full-scale test to determine its performance in a waste container used to simulate a hot cell. Table 3 summarizes the % by volume of the chemical additives used in the fogging solutions that greatly outperformed the baseline solution #201.

TABLE 3

Summary of the % Contribution by Volume of the Aqueous Fixatives Achieving Significantly Better Performance than the Baseline Glycerin Solution

| Solution | ALS | SLS | Glycerin | Latex Paint |
|---|---|---|---|---|
| #201 | — | — | Baseline | — |
| #203 | 7% | — | — | 20% |
| #204 | — | 5% | 10% | 10% |
| #206 | 7% | — | 5% | 5% |
| #212 | — | 5% | 7% | 10% |

While fogging solutions #206 and #212 performed the best, other fogging solutions performed satisfactorily as well. As stated above, these new coatings contain a surfactant to aid wetting and penetration of the lint and dust, a binder to stabilize loose or respirable particles, and an agent to aid in fogging and enhance adhesiveness. While we found these specific solutions to perform well, we would expect that these same solutions would perform acceptably if the chemical additives were added in different percentages. If the percentages are changed the resulting fogging solution must be able to produce a fog,
penetrate a consistent simulated lint coupon,
maintain a sticky surface over a period of hours,
wet the surface of the lint/dust and
prevent dust generation after dry.

While certain representative embodiments and details have been shown for purposes of illustrating the invention, it will be apparent to those skilled in the art that various changes in the methods and apparatus disclosed herein may be made without departing from the scope of the invention which is defined in the appended claims.

What is claimed is:

1. A method for preventing the release of airborne particulates in an enclosure comprising the steps of:
(a) producing a fog from an aqueous fixative including a latex paint, where the aqueous fixative includes glycerin;
(b) introducing and transporting the fog throughout the enclosure; and
(c) allowing the fog to coat and adhere the particulates to the walls of said enclosure.

2. The method of claim 1, where the particulates are derived from lint and dust that have accumulated in the ductwork.

3. The method of claim 1, where the particulates contain dangerous or harmful contaminants.

4. The method of claim 1, where the particulates contain radionuclides.

5. The method of claim 1, where an aerosol generating system including ultrasonic transducers is used to produce, introduce and transport the fog to the ductwork.

6. The method of claim 1, where a pneumatic nebulizer system is used to produce, introduce and transport the fog to the ductwork.

7. The method of claim 1, where the enclosure is selected from the group consisting of ductwork, a building, and rooms in a building.

8. The method of claim 1, where the particulates are derived from lint and dust that have accumulated in the ductwork.

9. The method of claim 1, where the enclosure may be any partial or fully enclosed structure.

10. A method for prevent the release of airborne particulates in an enclosure comprising the steps of:
(a) producing a fog from an aqueous fixative including a latex paint, where the aqueous fixative includes a surfactant and glycerin;
(b) introducing and transporting the fog throughout the enclosure; and
(c) allowing the fog to coat and adhere the particulates to the walls of said enclosure.

11. The method of claim 10, where the surfactant includes ammonium lauryl sulfate.

12. The method of claim 10, where the surfactant includes sodium lauryl sulfate.

13. The method of claim 10, where the aqueous fixative includes ammonium lauryl sulfate.

14. The method of claim 13, where the aqueous fixative solution includes by volume less than 15% ammonium lauryl sulfate, less than 25% glycerin, and less than 25% latex paint.

15. The method of claim 13, where the aqueous fixative solution includes by volume 5% to 10% ammonium lauryl sulfate, 3% to 10% glycerin, and 3% to 10% latex paint.

16. The method of claim 10, where the aqueous fixative includes sodium lauryl sulfate.

17. The method of claim 16, where the aqueous fixative solution includes by volume less than 15% sodium lauryl sulfate, less than 25% glycerin, and less than 25% latex paint.

18. The method of claim 16, where the aqueous fixative solution includes by volume 5% to 10% sodium lauryl sulfate, 3% to 10% glycerin, and 3% to 10% latex paint.

19. The method of claim 10, where the aqueous fixative solution includes by volume less than 15% surfactant, less than 25% glycerin, and less than 25% latex paint.

20. A method for preventing the release of airborne particulates in an enclosure comprising the steps of:

(a) producing a ting from an aqueous fixative including a polymeric barrier system binder and glycerin;

(b) introducing and transporting the fog throughout the enclosure; and (c) allowing the fog to coat and adhere the particulate to the walls of the enclosure.

21. The method of claim 20, where the aqueous fixative solution includes by volume less than 15% surfactant, less than 25% glycerin, and less than 25% polymeric barrier system.

22. The method of claim 21, where the aqueous fixative solution includes by volume 5% to 10% ammonium lauryl sulfate, 5% to 15% glycerin, and 5% to 15% polymeric barrier system.

23. A method for preventing the release of airborne particulates in an enclosure comprising the steps of:

(a) producing a fog from an aqueous fixative including a latex paint, where the aqueous fixative includes a surfactant and where the aqueous fixative solution includes by volume less than 15% surfactant and less than 25% latex paint;

(b) introducing and transporting the fog throughout the enclosure; and (c) allowing the fog to coat and adhere the particulates to the walls of said enclosure.

24. The method of claim 23, where the aqueous fixative solution includes by volume less than 15% ammonium lauryl sulfate.

25. The method of claim 23, where the aqueous fixative solution includes by volume less than 15% sodium lauryl sulfate.

26. The method of claim 23, where the aqueous fixative solution includes by volume 5% to 10% ammonium lauryl sulfate, and 15% to 25% latex paint.

27. The method of claim 23, where the aqueous fixative solution includes by volume 5% to 10% sodium lauryl sulfate, and 15% to 25% latex paint.

28. A method for preventing the release of airborne particulates in an enclosure comprising the steps of:

(a) producing a fog from an aqueous fixative including a latex paint;

(b) introducing and transporting the fog throughout the enclosure; and (c) allowing the fog to penetrate, coat, and adhere the particulates to the walls of said enclosure, where said aqueous fixative solution is comprised of a surfactant agent to aid wetting and penetration of the particulates, a binding agent to stabilize loose or respirable particulates, and an agent to aid in fogging and to enhance adhesiveness, where an agent may serve one or more functions.

29. The method of claim 28, where the aqueous fixative solution includes by volume less than 15% surfactant agent, less than 25% binding agent, and less than 25% agent to aid in fogging and adhesiveness.

30. The method of claim 29, where the aqueous fixative solution includes by volume less than 15% surfactant agent selected from the group consisting of ammonium lauryl sulfate and sodium lauryl sulfate, less than 25% of the binding agent glycerin, and less than 25% latex paint as the agent to aid in fogging and adhesiveness.

31. The method of claim 28, where the enclosure is selected from the group consisting of ductwork, a building, and rooms of a building.

32. The method of claim 28, where the particulates are derived from lint and dust that have accumulated in the ductwork.

33. The method of claim 28, where the particulates contain dangerous or harmful contaminants.

34. The method of claim 28, where the particulates contain radionuclides.

35. The method of claim 28, where an aerosol generating system including of ultrasonic transducers is used to produce, introduce and transport the fog to the ductwork.

36. The method of claim 28, where a pneumatic nebulizer system is used to produce, introduce and transport the fog to the ductwork.

37. The method of claim 28, where the enclosure may be any partial or fully enclosed structure.

* * * * *